United States Patent [19]

Huck

[11] 4,296,857

[45] Oct. 27, 1981

[54] PROTECTIVE BAND FOR PHOTOSENSITIVE FILM ON SPOOLS

[75] Inventor: William V. Huck, White Bear Lake, Minn.

[73] Assignee: Minnesota Mining and Manufacturing Company, St. Paul, Minn.

[21] Appl. No.: 112,159

[22] Filed: Jan. 16, 1980

[51] Int. Cl.[3] ..... B65D 85/67; B65D 85/671

[52] U.S. Cl. ..... 206/53; 206/400

[58] Field of Search ..... 206/53, 443, 398, 400

[56] References Cited

U.S. PATENT DOCUMENTS

| | | | |
|---|---|---|---|
| 1,468,636 | 9/1923 | Hoeft | 206/53 |
| 1,857,523 | 5/1932 | Wittel | 206/53 |
| 2,397,087 | 3/1946 | Camras | 206/53 |
| 2,822,919 | 2/1958 | Kulka | 206/53 |
| 3,156,353 | 11/1964 | Harnish | 206/53 |
| 3,235,087 | 2/1966 | Hultgren | 206/53 |
| 3,237,796 | 3/1966 | Callahan | 206/443 |
| 3,251,462 | 5/1966 | Hultgren | 206/53 |
| 3,311,228 | 3/1967 | Kulka | 206/53 |
| 3,343,667 | 9/1967 | Tellen | 206/53 |
| 3,401,793 | 9/1968 | Hess | 206/53 |
| 3,525,427 | 8/1970 | Kulka | 206/53 |

*Primary Examiner*—William T. Dixson, Jr.

*Attorney, Agent, or Firm*—Cruzan Alexander; Donald M. Sell; Mark A. Litman

[57] ABSTRACT

Photosensitive film carried on spools is ordinarily protected from ambient light by opaque covering strips which must be manually removed. Removal of these strips often causes some exposure and wastage of the film. The present invention discloses a protective band which removes itself when the film is fed out under tension.

10 Claims, 4 Drawing Figures

PROTECTIVE BAND FOR PHOTOSENSITIVE FILM ON SPOOLS

FIELD OF THE INVENTION

The present invention relates to spools or reels of photosensitive film. In particular, the present invention relates to opaque protective strips that generally overlay photosensitive film which is carried on spools to prevent exposure of the film. These protective strips, particularly when used on spools carrying microfilm, are sometimes referred to as belly-bands.

BACKGROUND OF THE INVENTION

It is convenient to provide some photosensitive film materials on spools for ready delivery to exposing apparatus. Conventional photographic film is supplied in this manner by placing a spool inside of a cartridge or cylinder and having one end of the film extend out of the cartridge or cylinder. Microfilm and motion picture film, for example, are often provided on spools in which the film is wrapped about itself over a central core. The American National Standards Institute, Inc. has provided dimensions for a standard microfilm spool as ANSI PH1.33-1972.

The light-sensitive nature of the film requires that it be protected from incident radiation so as not to expose any of the film. Not only is unexposed light-sensitive film carried in opaque containers, but also it is common to use gummed paper strips, circular plastic bands, or self-adherent bands over the film to both keep it secured on the spool and protected from light. Before using the film in a camera, this strip must be manually removed from the spool. This can be moderately inconvenient to the user, and some of the film may be exposed during this removal because it must be performed well before insertion of the film into a camera.

It is one aspect of the present invention to provide a band to secure and protect light sensitive film on spools without causing significant inconvenience to the user in its removal.

SUMMARY OF THE INVENTION

A light opaque tape, strip or band which is at least slightly longer than the outside circumference of the film where it is rolled about the core of a spool, the band (referred to as a belly-band) having a pre-set curl thereon, will protect and secure the film and yet be readily removed upon feeding out of the film under moderate tension.

The belly-band is wrapped over the film and is long enough to extend over itself with at least a small amount of the film extending out between the area of overlap to provide a 'leader' for the user.

DETAILS OF THE INVENTION

The light opaque band of the present invention performs a number of various functions which require particular properties in the material and construction of the band. The band must be opaque since it is to block light from reading the photosensitive film. If the film is sensitive to only one portion of the electromagnetic spectrum, the band need only be opaque to that portion of the spectrum. In general, however, the band is opaque to all visible light, and, if need be, ultraviolet and infrared light.

The band must also cover most or all of the entire width of the spool within which the film is wrapped.

The width of the band should be equal to or greater than the spacing between the flanges, preferably between 95 (i.e., nearly equal to the spacing) and 115% of the distance between flanges so as to screen out most of the light. More preferably, the band is between 98 and 110% of the width. When the band width exceeds the distance between the flanges, it or the flanges flex to fit snugly along the walls.

The band must also have a memory imposed on it so that when tension is placed on the film between overlapping portions of the band, the memory will cause the end of the band to curl and slip over the edge of the flange and away from the film. This memory must be sufficient to have the band, in its natural state, displaced from a spiral configuration to a helical configuration by at least one eighth the width of the band or usually at least about 0.5 cm.

Preferably this displacement or pitch is one-half to eight times the width of the band. With the leading upper end of the band cut at an acute angle from the edge of the band towards which the band is predisposed to curl, smaller displacements are more readily acceptible. The memory in the band should be able to withstand reasonable ambient temperatures and storage times.

The band itself may be made out of any material which is opaque and has the ability to hold an elastic memory. Such materials as metals and plastics are preferred. Metals such as steel, stainless steel, and aluminum would be preferred, but any others which could hold an elastic memory would be useful. Plastics such as polyesters, polyamides and polyvinyls (including, for example, both polyvinylchloride and polyvinylidene chloride) are preferred, but again, any plastic, such as polyolefins, polycarbonates and polyacrylates, which can retain an elastic memory would be suitable.

The thickness of the band will depend upon a number of factors including the material selected. For example, with polymeric resins, a useful range of thickness would be 0.010 to 0.025 inches. Metal bands, because of their properties, may be significantly thinner. Bands of other materials, depending upon their physical properties may be thicker or thinner, probably within a range of 0.003 to 0.050 inches.

The band in its relaxed state will desirably have enough circular or helical axial orientation so as to have its ends overlap each other or pass by each other in an axial direction. This will enable the band to securely grip the film. This overlap in its relaxed state is not essential, particularly when the width of the band is in excess of the width of the spool so that the sides of the flanges may hold the band securely in position on the film.

These and other characteristics of the present invention will become clear by reference to the drawings.

DESCRIPTION OF THE DRAWINGS

The practice of the present invention can be readily understood from a detailed review of the drawings. FIG. 1 shows a helical band of metal (1) in an essentially relaxed state. The band may be essentially rectangular in shape or the edges at the end may be rounded or in any other configuration. In fact, it has been found that where the upper portion of the band has been cut at an acute angle (e.g., between 85° and 45°) away from the edge of the band towards which the band is disposed to curl, the band may generally be removed more easily. The distance between the edges $W_1$ and $W_2$ constitutes the width (W) of the band. The distance traveled along the band from $L_1$ to $L_2$ is the length (L) of the band. The distance between $d_1$ and $d_2$ is the diameter (D) of the band. The distance from one edge ($p_1$) of the helical band to the next edge ($p_2$) facing in the same axial direction is the pitch (P).

Figure 1:
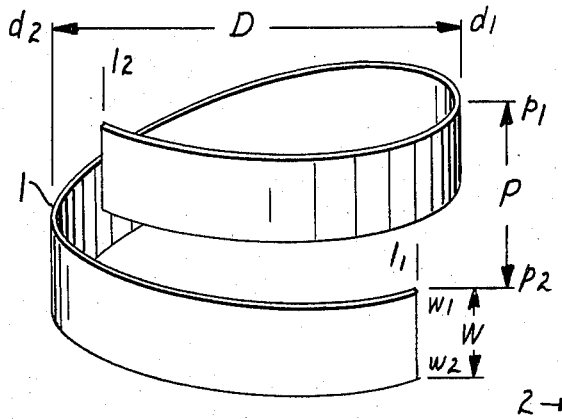
FIG. 1 shows a helical band useful as a protective belly-band according to the present invention.
Figure 2:
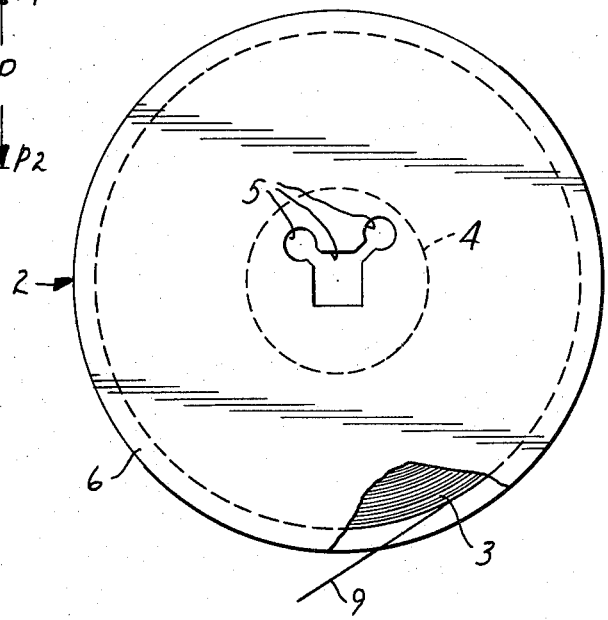
FIG. 2 shows a side view of a spool having photosensitive film wound about it with one flange removed therefrom and the core sectioned.

In the cross section of FIG. 2 a typical roll of photosensitive film on a spool (2) is shown. The film (3) is wrapped about the core (4) and is abutted on the side by the flange (6). Spindle holes (5) are shown on the sectioned core (4) of the spool (2). A length of film (3) is shown extended from the spool as a leader (9).

Figure 3:
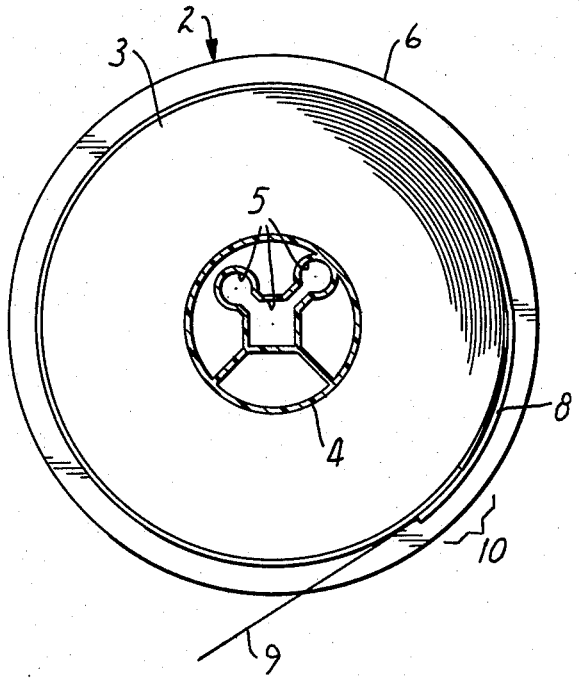
FIG. 3 shows a side view of a spool having the belly-band of the present invention over photosensitive film.

In the cross section of FIG. 3, a belly-band (8) according to the present invention is shown. This band (8) overlaps the film (3) wrapped about the core (4). The band (8) overlaps itself (10) because the length of the band (8) is in excess of the greatest circumference of the wrapped film (3). At the point of overlap (10), a portion of the film (3) extends between the overlapping portions of the band (8) to provide a leader (9). Pulling on the leader (9) will raise the upper portion (11) of the band and lift it over the highest edge of the flange (6). When the upper portion (11) of the band is over the flange (6), the curl in the band (8) will cause the raised portion (11) of the band to move over the edge of the flange (6). Continued feeding of the film (3) will raise more of the band (8) over the edge of the flange (6) until all of the band (8) has moved out of the area between the flanges (6) and the film (3) may be fed freely.

Figure 4:
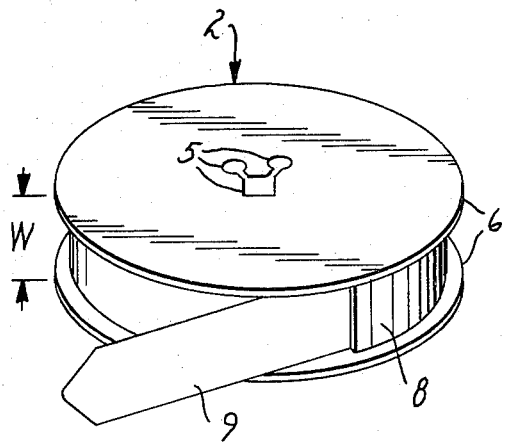
FIG. 4 shows a perspective of a spool having the belly-band of the present invention over photosensitive film.

In the perspective of FIG. 4, it can be seen that the band (8) must fill the width (W) between the flanges (6) to provide protection for the film. The leader (9) can be seen extending from the spool (2) with the belly-band (8) of the present invention.

These and other aspects of the present invention will be further described in the following examples.

EXAMPLE 1

A spool for 16 mm microfilm with the following dimensions was used. The outside diameter of the core was 32 mm and the diameter of the flanges was 92 mm. The width (W) between the flanges was 16.2 mm. One hundred (100) feet (30.48 m). A stainless steel band having the following dimensions and properties was then cut. The band had a length (L) of 26.67 cm, a width (W) of 1.68 cm, a thickness of 0.026 cm, a coil diameter (D) of 5.4 cm and a left handed pitch (P) of 3 cm. The band was placed over the film wrapped about the core between the flanges of the spool. The band overlapped itself by a few centimeters. The upper end of the band was raised and about a ten centimeter leader length of film was pulled out to extend from between the overlap of the band. The top end of the band was then pressed down onto the film again to a secure position. The band fit snugly between the walls of the flanges. Upon pulling the leader from the spool, the band was raised over the edge of the flange and it curled to one side of the spool. Upon pulling further lengths of film from the spool, more and more of the band was raised over the edge of the flange until the entire band released itself from the spool.

EXAMPLE 2

A coil having the same dimensions as that of Example 1 but made of polyethyleneterephthalate of 0.062 cm thickness filled with carbon black to render it opaque was used on a roll of microfilm as in Example 1. The polyester coil performed in substantially the same manner as the metal coil.

What is claimed is:

1. A spool and photosensitive film comprising a core and flanges extending from the core and having photosensitive film wrapped in a spiral about the core and between the flanges having as an improvement thereon an opaque band having a width nearly equal to or greater than the width between the flanges, a length in excess of the circumference of the outermost layer of film on the spool, so that the band overlaps itself, and a pitch in its relaxed state of from one eighth to eight times the width of the band, and a portion of the film extending out from the area where the band overlaps itself.

2. The spool and film of claim 1 wherein the opaque band has a width between 0.95 and 1.15 times the width between the flanges.

3. The spool and film of claim 1 wherein said band is made of metal or plastic.

4. The spool and film of claim 3 wherein said band has a width between 0.98 and 1.10 times the width between the flanges.

5. The spool and film of claim 1 wherein said film is unexposed microfilm.

6. The spool and film of claim 3 wherein said film is unexposed microfilm.

7. The spool and film of claim 2 wherein the end of the band which is outermost over the film is cut at an acute angle away from the direction toward which the band is disposed to curl.

8. The spool and film of claim 3 wherein the band has sufficient circular or helical axial orientation in its relaxed state so as to have its ends overlap or pass by each other in its axial direction.

9. The spool and film of claim 3 wherein the band has a thickness between 0.003 and 0.050 inches.

10. The spool and film of claim 1 wherein the pitch of the band in its relaxed state is from one half to eight times the width of the band.

* * * * *